US010087631B2

(12) United States Patent
Torres et al.

(10) Patent No.: US 10,087,631 B2
(45) **Date of Patent: *Oct. 2, 2018**

(54) ROOF TILES AND ROOF TILE STRUCTURES AND METHODS OF MAKING SAME

(71) Applicants: Carlos Torres, Madera, CA (US); Wilbur Dale McIntire, Bakersfield, CA (US)

(72) Inventors: Carlos Torres, Madera, CA (US); Wilbur Dale McIntire, Bakersfield, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/450,229

(22) Filed: Mar. 6, 2017

(65) Prior Publication Data

US 2017/0175392 A1 Jun. 22, 2017

Related U.S. Application Data

(63) Continuation of application No. 14/246,446, filed on Apr. 7, 2014, now Pat. No. 9,624,669, which is a continuation of application No. 12/803,365, filed on Jun. 24, 2010, now Pat. No. 8,728,609, which is a continuation-in-part of application No. 11/747,911, filed on May 13, 2007, which is a continuation-in-part of application No. 11/348,173, filed on Feb. 6, 2006.

(60) Provisional application No. 60/717,608, filed on Sep. 17, 2005.

(51) Int. Cl.

| | |
|---|---|
| ***E04D 1/10*** | (2006.01) |
| ***E04D 1/08*** | (2006.01) |
| ***E04D 1/28*** | (2006.01) |
| ***E04D 1/34*** | (2006.01) |
| ***E04D 1/04*** | (2006.01) |

(52) U.S. Cl.

CPC ..... *E04D 1/10* (2013.01); *E04D 1/04* (2013.01); *E04D 1/08* (2013.01); *E04D 1/28* (2013.01); *E04D 1/34* (2013.01); *E04D 2001/3458* (2013.01)

(58) Field of Classification Search

CPC .... E04D 1/10; E04D 1/04; E04D 1/28; E04D 1/08; E04D 1/34; E04D 2001/3458

USPC ..... 52/519, 521, 522, 523, 524, 525, 537, 52/556, 309.4, 309.12, 309.13, 794.1

See application file for complete search history.

(56) References Cited

U.S. PATENT DOCUMENTS

| | | | | | |
|---|---|---|---|---|---|
| 3,349,534 | A * | 10/1967 | Wotherspoon | E04D 1/045 | 52/520 |
| 4,229,497 | A * | 10/1980 | Piazza | B28B 19/003 | 264/256 |
| 4,578,915 | A * | 4/1986 | Schneller | B32B 13/12 | 52/309.12 |
| 4,774,794 | A * | 10/1988 | Grieb | E04B 7/225 | 52/309.12 |
| 5,077,952 | A * | 1/1992 | Moore | E04D 1/34 | 52/489.1 |
| 5,323,580 | A * | 6/1994 | Thomas | E04D 1/34 | 52/489.1 |
| 5,362,342 | A * | 11/1994 | Murray | B29B 7/7678 | 156/575 |
| 5,533,313 | A * | 7/1996 | Pike | E04D 1/34 | 52/521 |

(Continued)

*Primary Examiner* — Brent W Herring
(74) *Attorney, Agent, or Firm* — H. Michael Brucker

(57) ABSTRACT

A roof tile having a mesh covered foam core with a cement-based protective coating, a roof covering formed from such tiles and methods for making same.

7 Claims, 10 Drawing Sheets

(56) References Cited

U.S. PATENT DOCUMENTS 5,651,226 A * 7/1997 Archibald ..... E04D 1/045 126/622
5,722,212 A * 3/1998 Struve ..... E04D 1/34 52/489.1
6,006,480 A * 12/1999 Rook ..... B32B 5/18 52/309.12
6,941,706 B2 * 9/2005 Austin ..... E04D 13/004 52/302.3
7,320,774 B2 * 1/2008 Simmons ..... B28B 7/0082 264/162
8,082,716 B1 * 12/2011 Worley ..... E04D 1/34 52/520
8,580,172 B2 * 11/2013 Simmons ..... B28B 7/0082 264/157
8,728,609 B2 * 5/2014 Torres ..... E04D 1/08 428/157
2002/0139082 A1 * 10/2002 DeFord ..... E04C 2/04 52/783.1
2004/0123544 A1 * 7/2004 Simmons ..... B28B 7/0082 52/519
2006/0026918 A1 * 2/2006 Colombo ..... E04D 1/265 52/385
2006/0254207 A1 * 11/2006 Mulligan ..... E04D 11/02 52/794.1
2008/0010933 A1 * 1/2008 Faulkner ..... B32B 5/18 52/411
2008/0066423 A1 * 3/2008 Simmons ..... B28B 7/0082 52/745.2
2010/0101169 A1 * 4/2010 Logan ..... E04D 1/16 52/518
2010/0147195 A1 * 6/2010 Walloch ..... C04B 28/02 106/660
2010/0269440 A1 * 10/2010 Torres ..... E04D 1/08 52/309.4
2014/0069036 A1 * 3/2014 Noton ..... E04D 1/04 52/173.3
2015/0152641 A1 * 6/2015 Torres ..... E04D 1/08 52/521

* cited by examiner 11
14
1B
1B
89
85
15
64
96

29
14
86
13
56
95
98
57
94
86
96
97
53
99
59
87
12

11
57
56
1D
53
86
14b
14a
14
14
16
13
12
28
1C
43
47
46
87

13
12
86
14
91
49
93
43
89
88
90
47
92
46
86
28
87

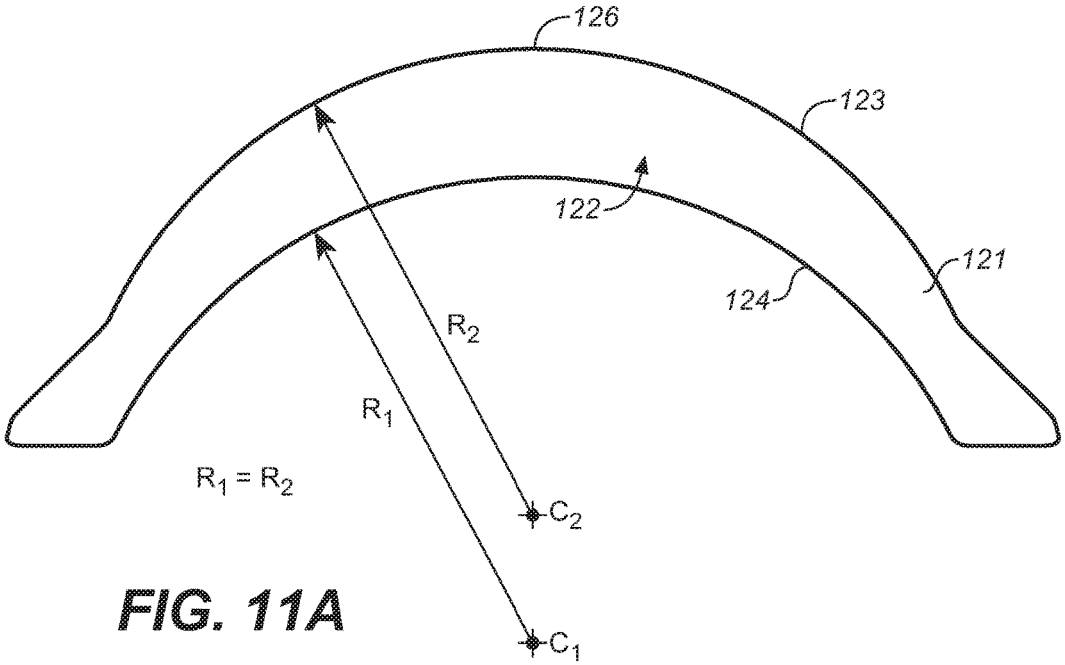
FIG. 11A
FIG. 11B
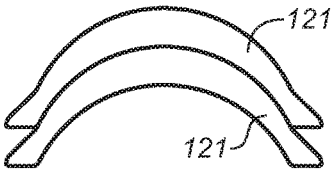
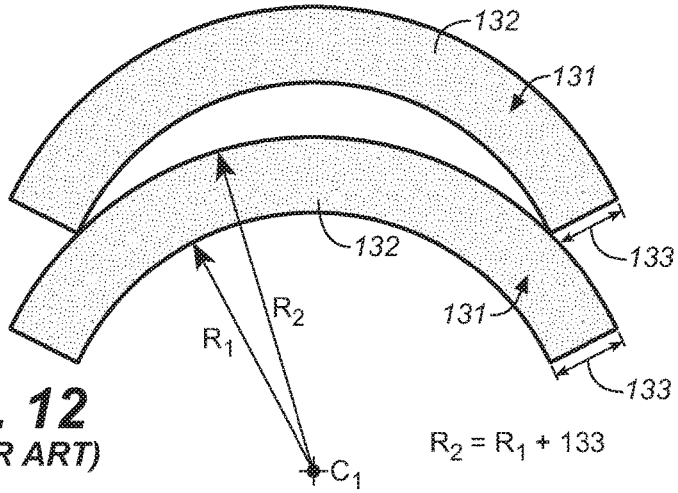
FIG. 12
(PRIOR ART)

ROOF TILES AND ROOF TILE STRUCTURES AND METHODS OF MAKING SAME

CLAIM OF PRIORITY

The present application pending is a continuation of allowed U.S. patent application Ser. No. 14/246,446, filed on Apr. 7, 2016, which has issued as U.S. Pat. No. 9,624,609, which is a continuation application of allowed U.S. application Ser. No. 12/803,365, filed Jun. 24, 2010, which has issued as U.S. Pat. No. 8,728,669,745 on May 20, 2014, which is a continuation-in-part of abandoned U.S. patent application Ser. No. 11/747,911, which is a continuation-in-part of abandoned U.S. patent application Ser. No. 11/348,173, filed Feb. 6, 2006, which claims the benefit of Provisional Patent Application No. 60/153,917, filed Sep. 6, 2006.

FIELD OF THE INVENTION

The present invention relates to roof tiles, roof coverings and methods of making and installing same. The roof tiles of the present invention are insulating roof tiles that are lightweight, highly fire resistant, strong and durable. The roof tiles to which the present invention pertains are those that are of a size common in the industry and which are used to cover a roof structure by arranging a plurality of such tiles in overlapping relationships to each other. The industry standards for roof tiles of the type to which the present invention relate are typically 15 to 20 inches long (along the roof pitch), 10 to 20 inches wide and 1 to 2 inches thick, all depending on the shape of the tile and the aesthetic appearance desired. Such tiles are not load-bearing elements of a roof structure, but are themselves a roof structure load.

As used throughout, the terms "roof tile" and "tile", unless otherwise specified, mean an individual element generally of the dimensions set out above designed to be arranged, along with a plurality of like elements, in overlapping relationship to each other to form a waterproof covering or membrane over a roof structure.

BACKGROUND OF THE INVENTION

Tiles of various compositions have been used since ancient times to provide a protective membrane over building roof structures of all kinds.

Fire resistant roof tiles are typically made of clay, cement or metal. Although aesthetically, clay and cement tiles are preferred, their major drawbacks are that they are extremely heavy and very fragile, making installation difficult and expensive and requiring more robust support structures than for known lighter roof coverings. On the other hand, clay and cement tiles have the advantage of durability and fire resistance. The present invention provides a roof tile that has the durable and fire resistant qualities of cement and clay while being as much as 40% lighter and vastly stronger.

SUMMARY OF THE INVENTION

The present invention comprises a roof tile of industry standard size having a foam core covered with a strengthening material (e.g., fiberglass mesh) and a thin outer cement-based protective coating (cured cement slurry). The cement-based protective coating includes one or more additives that impart excellent water repellant properties to the tile surface and increases its strength, durability and aesthetic appeal. The tile of the present invention has exceptional strength for its weight, which decreases shipping costs, virtually eliminates breakage during shipping and installation and requires only normal roof support structures.

In one embodiment, a cement-based slurry is applied to a mesh-covered foam core and cured to hardness, forming a non-porous coating that inhibits the intake of moisture thereby preventing deterioration from freezing/thaw cycles that are the bane of clay and cement tiles. In addition, the foam core of the tiles of the present invention provide greater insulating properties than cement or clay tiles, keeping interiors warmer in the winter and cooler in the summer. Although the tiles of the present invention are significantly lighter than clay or cement tiles, they provide greater strength and the same or greater fire resistance.

The roof tile of the present invention is lightweight, strong, has a high fire-resistance rating and a high insulation rating and can be easily formed into various cross-sectional shapes to increase aesthetic appeal and offers ventilation to the underside of the tiles. Thus, a roof tile, roof tile system (covering) and method of making and installing the same are provided in accordance with the invention, providing several structural, manufacturing and installation advantages.

BRIEF DESCRIPTION OF THE DRAWINGS

FIG. 11A is a side view of a tile of the invention having an arcuate section illustrating its variation in thickness;

FIG. 11B is a side view of two tiles of FIG. 11A in a nested relationship; and FIG. 12 is a side view of two tiles of the prior art shown in a nested relationship.

DETAILED DESCRIPTION OF THE DRAWINGS

Figures 1A, 1B, 1C, 1D:
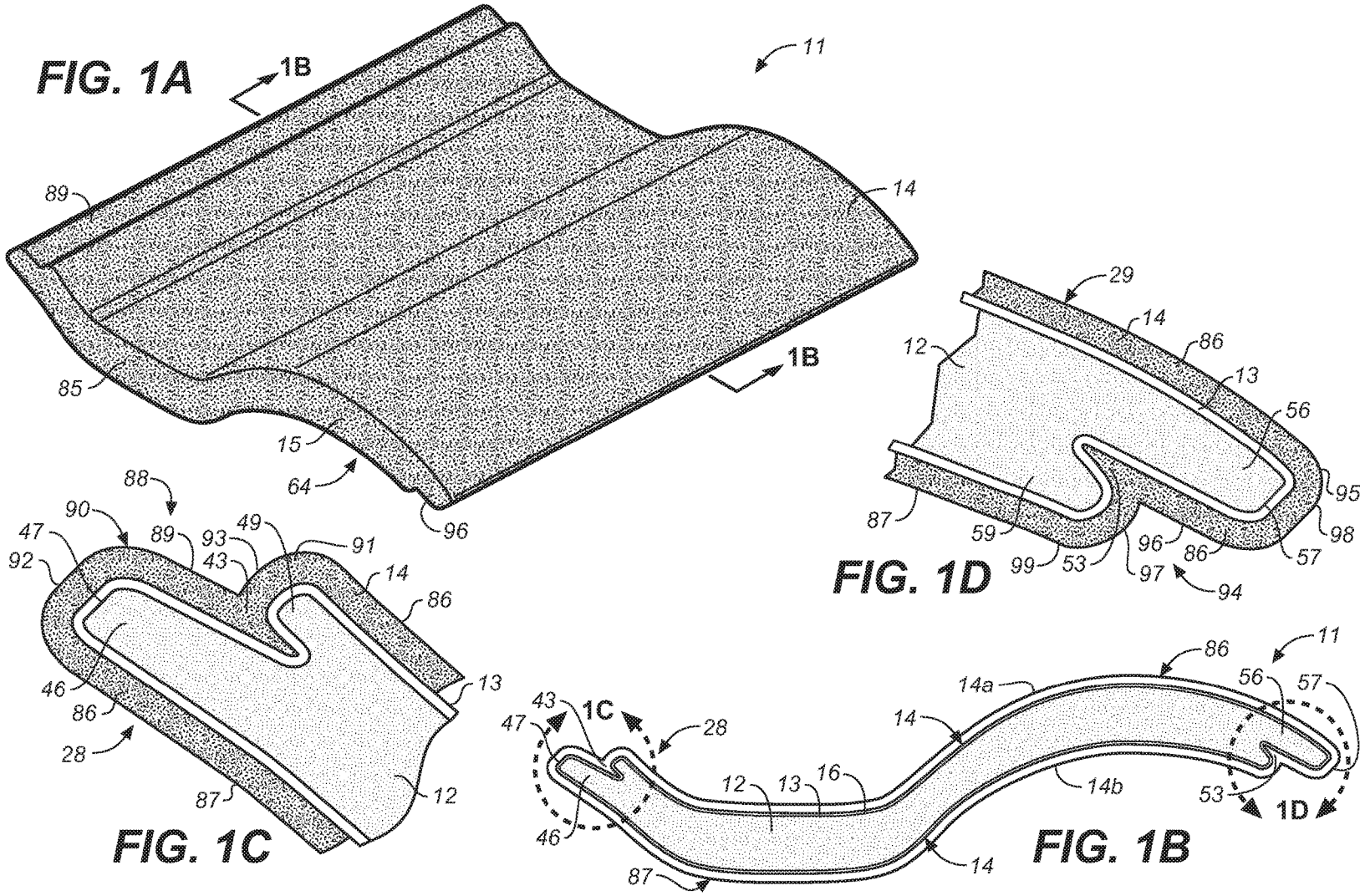
FIG. 1A is a perspective view of a roof tile according to the present invention.
FIG. 1B is a side sectional view taken along the line 1B-1B of FIG. 1, with certain dimensions exaggerated for ease of understanding.
FIG. 1C is an enlarged view of one end of the sectional view of FIG. 1B indicated 1C.
FIG. 1D is an enlarged view of the other end of the sectional view of FIG. 1B indicated 1D.
Figure 2A:
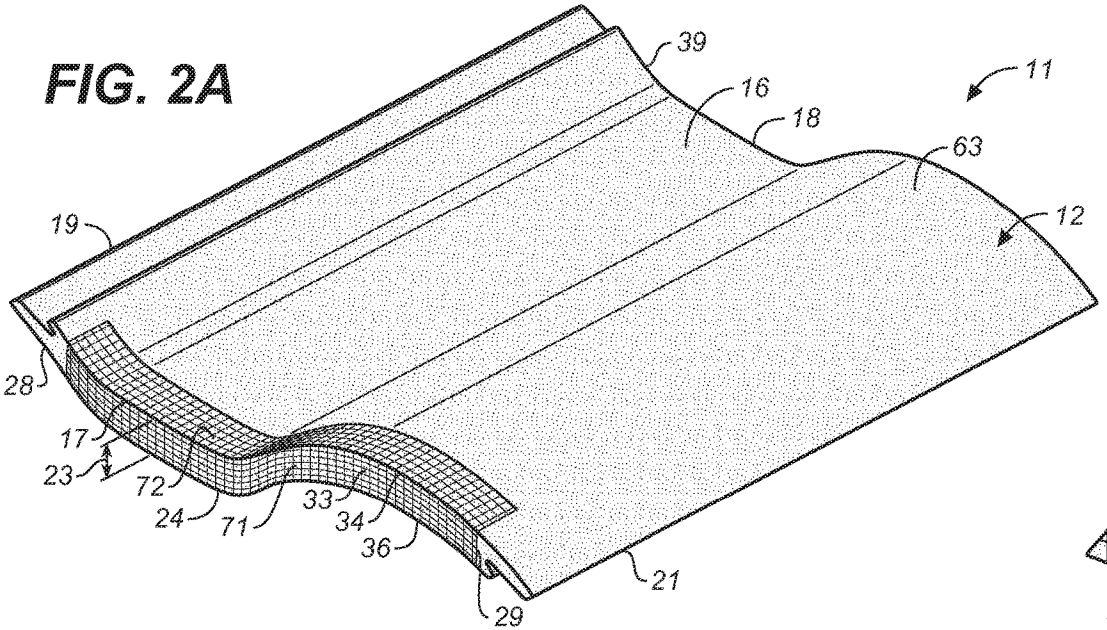
FIG. 2A is a perspective view of the foam core member of the tile of FIG. 1A with a side wall thereof having a strengthening material applied thereto.
Figure 2D:
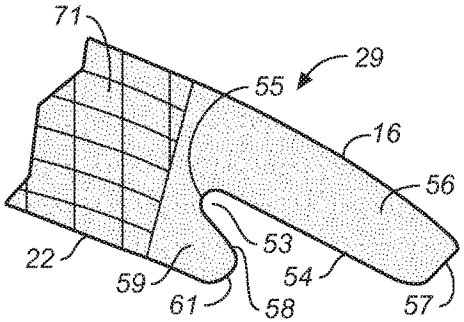
FIG. 2D is an enlarged view of the other end of the side view of FIG. 2B indicated 2D.
Figure 2B:
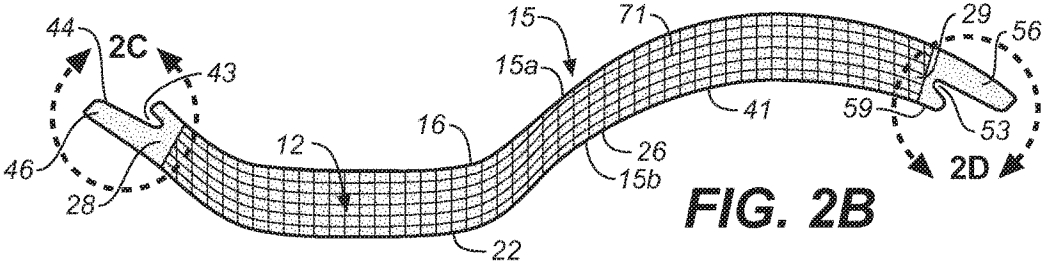
FIG. 2B is a left side view of FIG. 2A.
Figure 2C:
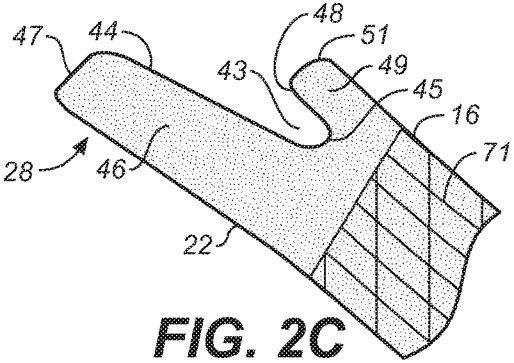
FIG. 2C is an enlarged view of one end of the side view of FIG. 2B indicated 2C.

Referring to FIGS. 1A, 1B, 1C and 1D, a roof tile 11 of the present invention comprises a foam core member 12 covered by a strengthening material 13 and a hardened cement-based protective coating 14. The drawings are not to scale and the relative thicknesses of the core 12, the strengthening material 13 and cement-based protective coating 14 are exaggerated for ease of illustration and better understanding.

While the particular shape of foam core 12 illustrated has certain advantages as more fully described below, many other shapes are possible within the teachings of the invention, with each shape having particular advantages and/or aesthetic appeal. Shapes that are primarily flat and shapes that are arcuate or include arcuate sections are all within the teachings of the invention.

Referring to FIGS. 2A-2D, the foam core 12 has an upper surface 16 bounded by a first lateral edge 17, a spaced-apart second lateral edge 18, a first end edge 19 and a spaced-apart second end edge 21. The length of core 12 is the distance between lateral edge 17 and lateral edge 18. The width of core 12 is the distance between end edge 19 and end edge 21. The foam core 12 further includes a lower surface 22 opposing and spaced apart from the upper surface 16 where the distance between the upper surface 16 and the lower surface 22 (as measured along a normal to the surfaces) determines the thickness 23 (FIG. 2A) of the foam core 12 at any point. The core lower surface 22 is bounded by a first lateral edge 24, a spaced-apart second lateral edge 26 (not shown), the first end edge 19 and the second end edge 21. As explained more fully below, for tiles having an arcuate section 15 with an upper surface 15*a* and a lower surface 15*b* (FIG. 2B), the thickness 23 (as measured along a normal to the surfaces) will vary whereby like tiles 11 can be overlapped and closely nested with each other with a portion of the lower surface of one tile fitting closely with a portion of the upper surface of another tile as more fully described below.

A first core side wall 33 has an upper edge 34 coextensive with the first upper surface lateral edge 17 and a spaced-apart lower edge 36 coextensive with the lower surface first lateral edge 24. A second side wall 38 (which is a mirror image of side wall 33 but not shown) spaced apart from the first side wall 33 has an upper edge 39 coextensive with the upper surface second lateral edge 18 and a spaced-apart lower edge 41 (FIG. 2B) coextensive with the lower surface second lateral edge 26.

The foam core member 12 has, at one end, a first slot forming end member 28 and, at the other end, a second slot forming end member 29. A first slot 43 (FIG. 2C) is formed between the foam core upper surface 16 and lower surface 22 in first end member 28 and has a closed slot end 45. A first slot surface 44 and lower core surface 22 define a first major end extension member 46 having a distal end 47. A second slot surface 48 spaced apart from and opposing the first slot surface 44 and upper core surface 16 define a first minor end extension member 49 that is shorter than major end extension 46 and has a distal end 51. The end 51 of first minor end extension 49 extends beyond closed slot end 45, but not as far as major extension end 47. In a preferred embodiment, end 51 of first minor extension 49 is approximately between one-sixth and one-third of the distance from closed slot end 45 as the distal end 47 of first major extension 46 is from closed slot end 45.

A second slot 53 (FIG. 2D) is formed in end member 29 between the upper core surface 16 and lower core surface 22 and has a closed slot end 55. A first slot surface 54 and upper surface 16 define a second major end extension member 56 having a distal end 57. A second slot surface 58 spaced apart from and opposing first slot surface 54 and lower surface 22 define a second minor edge extension member 59 that is shorter than second major end extension 56 and has a distal end 61. The end 61 of second minor end extension 59 extends beyond closed slot end 55, but not as far as second major extension end 57. In a preferred embodiment, end 61 of second minor extension 59 is a distance from closed slot end 55 approximately between one-sixth and one-third of the distance that the distal end 57 of second major extension 56 is from closed slot end 55.

The slots 43 and 53 in end members 28 and 29, respectively, play an important role in connection with the cement-based protective coating in forming reliable inter-tile connections as more fully described below.

Figure 9:
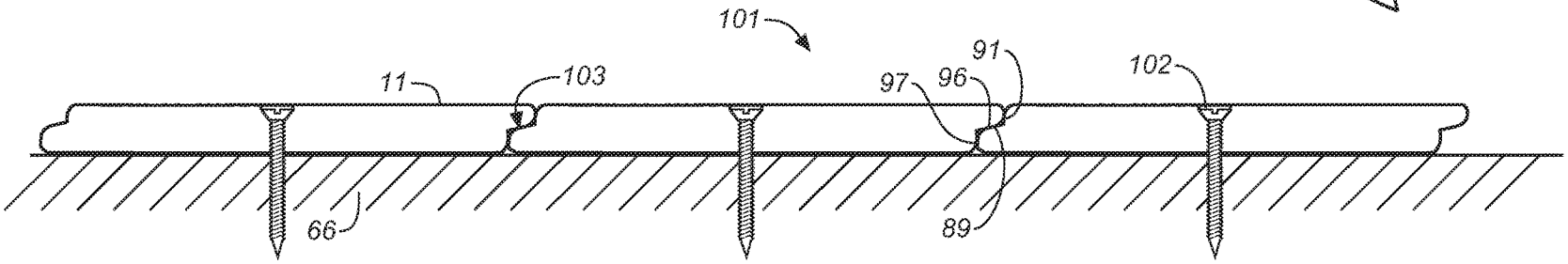
FIG. 9 is a sectional view of one tier of interlocking flat tiles.
Figure 10:
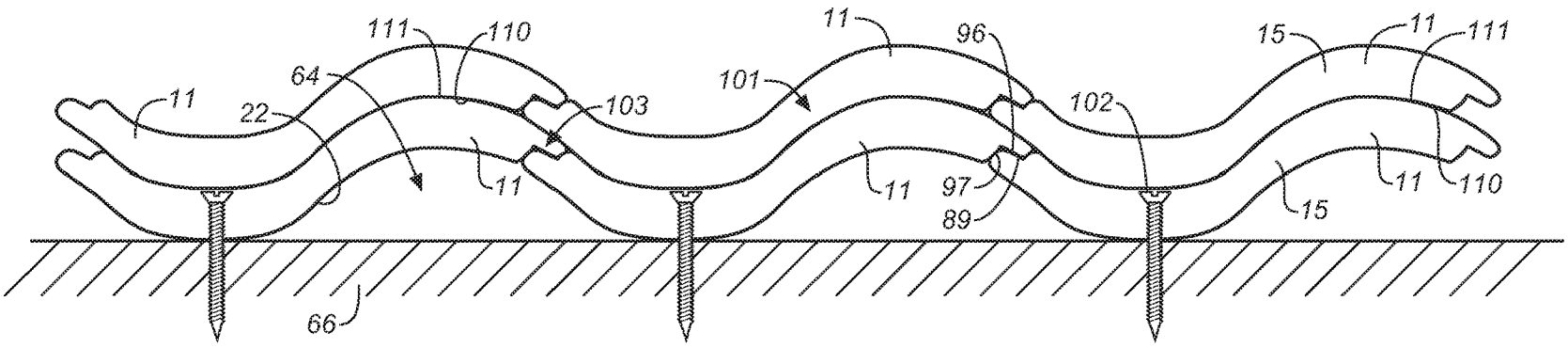
FIG. 10 is a sectional view taken along the line 10-10 of FIG. 6C.

In ways known in the art, the foam core 12 can be formed in a variety of shapes including, but not limited to, substantially flat to simulate a cedar or slate roof shingle (FIG. 9); curved to simulate a classic Spanish tile (FIG. 11A); or any other shape that permits multiple tiles to be arranged in overlapping relationship to provide a weatherproof covering and create a desired aesthetic (FIG. 10). The cement-based protective coating 14 can be textured, colored and finished to create the look of Spanish tile, cedar shingles, or any other roof tile now known or imagined.

A wide range of aesthetic choices are possible by virtue of the ease of forming the foam core 12 and the ability to color and texture the protective coating. This is in addition to the exceptional performance of the tile as a weather barrier, an insulator, an insect resister and a fire retardant. In all of these respects, the tile 11 of the present invention equals or out-performs equivalent tiles made of clay or cement while being anywhere from 30 to 60 percent lighter and significantly more damage resistant during transportation and installation. The tiles 11 are so strong that they easily support the weight of installers standing on them during installation. At the same time, the tiles can be nailed to the underlying roof structure without pre-drilling and without breaking or cracking. Further, they can be trimmed to size where needed with a handsaw.

In one embodiment, the foam core 12 is expanded polystyrene (EPS). EPS is generally produced from a mixture of about 95% polystyrene and 5% gaseous blowing agent (e.g. pentane). Other types of foam such as high density foam, Styrofoam™, blue board, polystyrene, injection foams, MDI monomer, polyurethane resins, extruded foam, expanded polystyrene, expanded plastic foam, expanded polyethylene and nylon can be used. As used herein unless indicated otherwise, the term "foam" includes EPS and its suitable substitutes.

In one embodiment, the foam core 12 is cut from a large block of foam with a computer-driven hot wire cutting machine specifically designed for such operations. In other embodiments, the foam core 12 can be extruded, molded or cast. It is the ability of the foam to be formed into a desired shape and size that gives the tile 11 of the present invention its ability to emulate the aesthetic appearance and shape of known roof tiles, as well as novel shapes not easily formed of clay or cement, while offering superior performance characteristics as pointed out above and more fully described below.

Figure 5A:
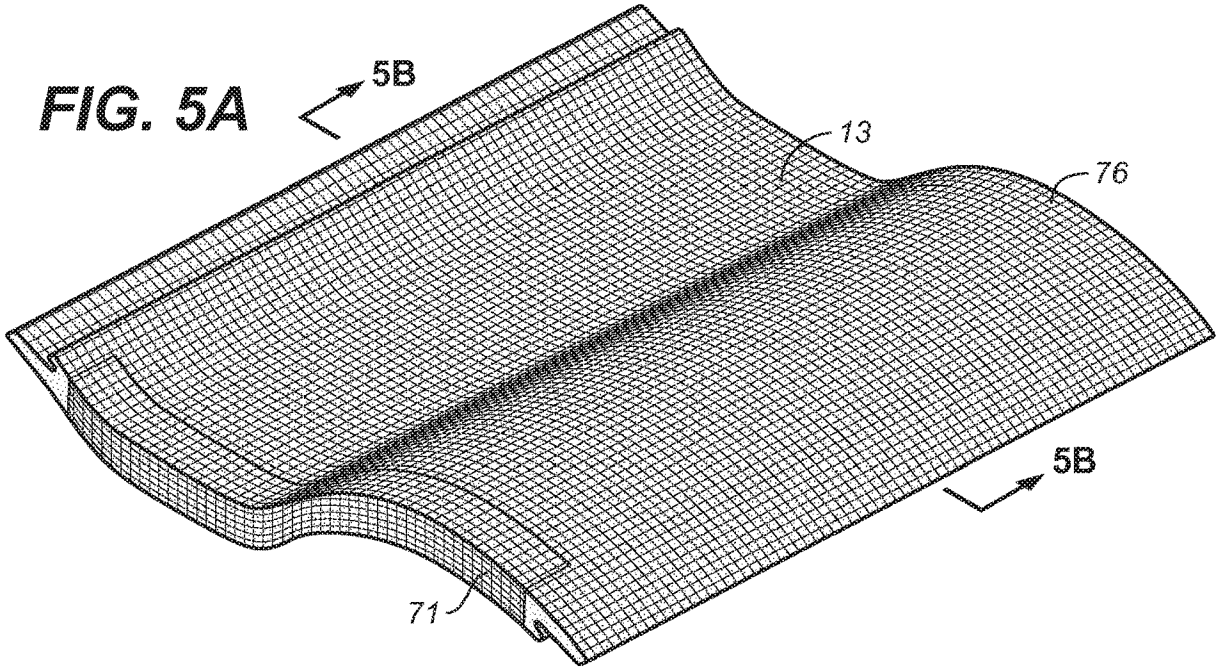
FIG. 5A is the same as FIG. 2A, but with the upper and lower surfaces of the core member covered with a strengthening material.

After the foam core member 12 is formed, including end member slots 43 and 53, the strengthening material 13 (FIGS. 5A and 5B) is applied. In a preferred embodiment, strengthening material 13 is a commercially available self-adhesive fiberglass mesh. The mesh provides the foam core with added strength and additional surface texture for the cement-based protective coating 14. Other strengthening materials may also be used including: polypropylene fiber mesh, polyurethane mesh, nylon mesh, and polymer-based mesh. Non-mesh strengthening materials may also be applied to the exterior of the foam as, for example, the copolymer known in the trade as Elotex™ FX2320 (a redispersible binder based on a copolymer of ethylene and vinyl acetate). In the cured state, this polymer has a high strength, an excellent freeze-thaw cycling resistance and is very flexible and impact resistant. It also adheres very strongly to foam. Alternatively, Elotex™ product FX2300 can be used in place of FX2320. All of these various strengthening materials applied to the surfaces of the foam core member 12 to increase its strength are within the meaning of "strengthening materials" as used herein.

Referring to FIGS. 2A-2D, in one embodiment of the invention, one portion of the strengthening material 13 is a strip of mesh material 71 applied to the first side wall 33 of foam core member 12 and a small section 72 of the immediately adjacent upper surface 16 and a similar small section 73 (not shown) of the immediately adjacent lower surface 22. It is advisable for the strip 71 not to cover any portion of slots 43 or 53. Thus, strip 71 does not cover the entire side wall 33. Applying a similar mesh strip to the second side wall 38 is optional.

Referring to FIGS. 3A, 3B, 4A and 4B, after the mesh strip 71 is adhered as described above, another portion of the strengthening material, mesh material sheet 76, is applied to the foam core member 11 to cover the upper surface 16 and the lower surface 22. The mesh sheet 76 has a first end edge 77, a second end edge 78, a first lateral edge 79 and a second lateral edge 81, wherein the lateral edges 79 and 81 are approximately parallel to each other, as are the end edges 77 and 78. The width of sheet 76 (as measured between lateral edges 79 and 81) is approximately equal to the distance between the foam core lower surface first lateral edge 24 and lower surface second lateral edge 26 (also upper surface first lateral edge 17 and upper surface second lateral edge 18).

Figure 4A:
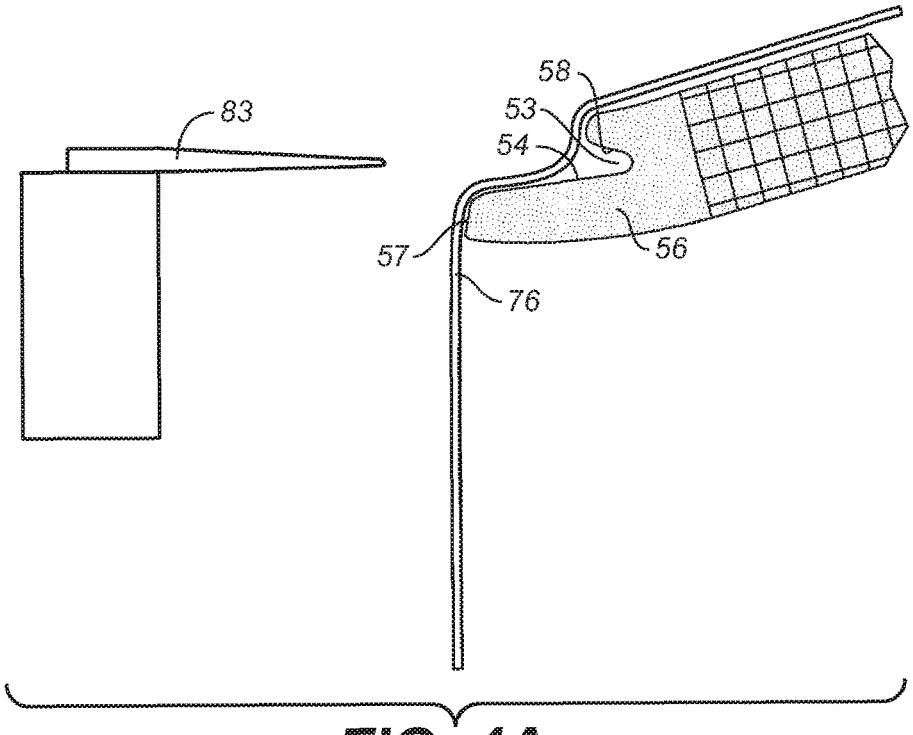
FIG. 4A is a partial side view of FIG. 3A illustrating the jig blade used to apply the strengthening material.
Figure 4B:
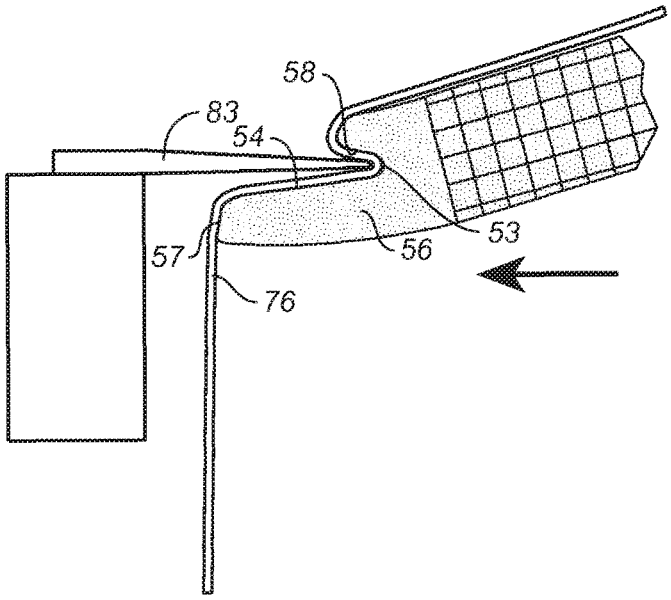
FIG. 4B is the same as FIG. 4A, with the jig blade illustrated engaging the strengthening material.

In one embodiment of the invention, in applying the mesh sheet 76 to the core 16, the first end edge 77 of mesh sheet 76 is located and secured at the approximate midsection of lower surface 22, with the mesh sheet lateral edges 79 and 81 immediately adjacent to lower surface first lateral edge 24 and lower surface second lateral edge 26, respectively. The sheet 76 is drawn towards the second core end member 29 and draped over the distal end 57 of second major extension 56 (FIG. 4A). A jig blade 83 is used to urge the mesh sheet 76 firmly into the slot 53 and onto slot surfaces 54 and 58 to which the mesh sheet 76 adheres (FIG. 4B). In the same way, the sheet 76 is secured within slot 43. It is the securing of sheet 76 into slots 43 and 53 that assures a proper shape to the end members 28 and 29 when the cement-based coating 14 is applied, as more fully described below (FIGS. 1C and 1D).

Figure 3A:
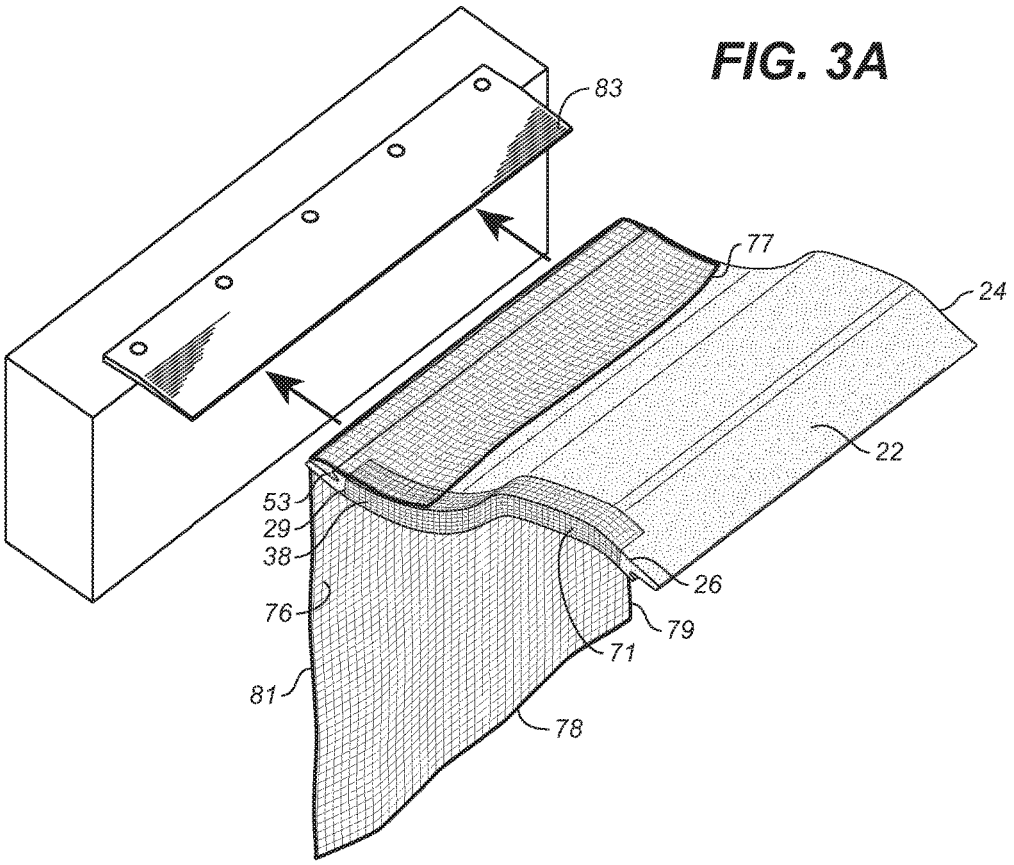
FIG. 3A is a perspective view of the core member of FIG. 2A shown in the process of being covered with a strengthening material and in relation to a production jig blade.
Figure 3B:
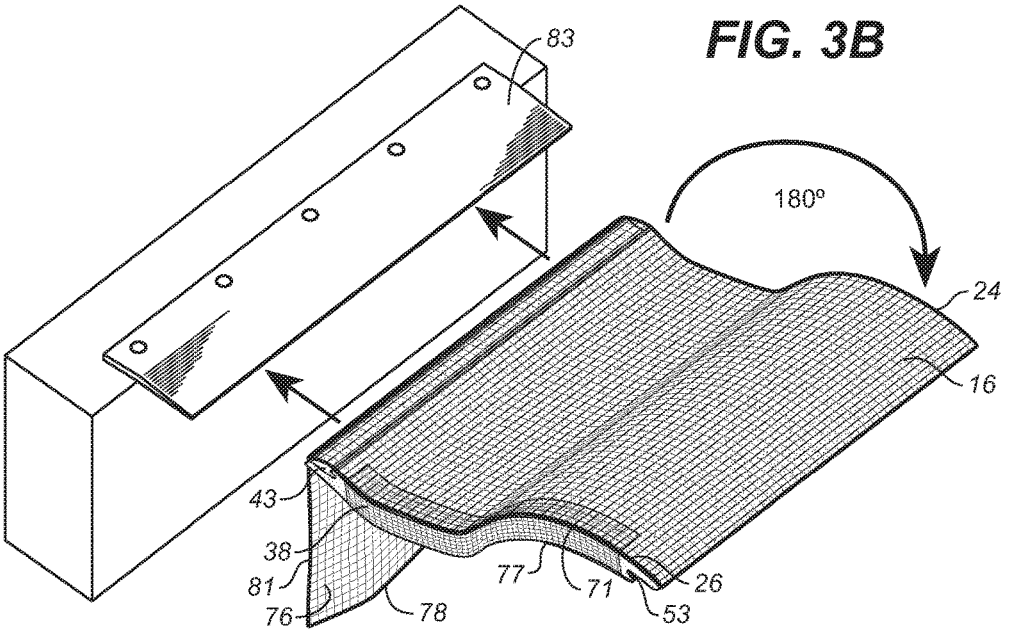
FIG. 3B is the same as FIG. 3A, with the core member flipped over and more of the strengthening material applied to the core member.
Figure 5B:
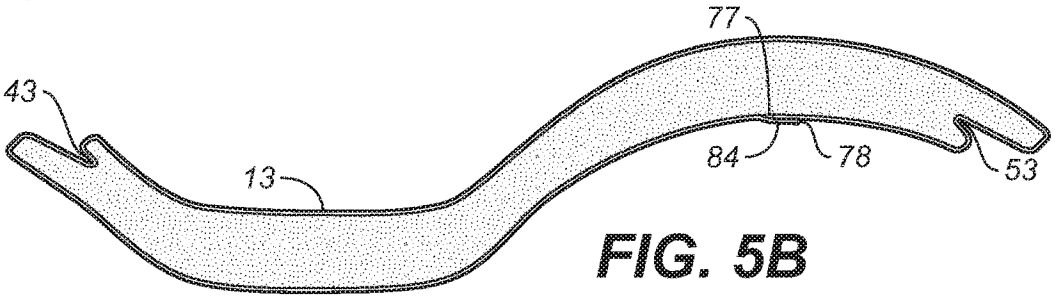
FIG. 5B is a sectional side view of FIG. 5A taken along the line 5B-5B of FIG. 5A.

Referring also to FIG. 3B, after the mesh sheet 76 is secured within slot 53, the core member 12 is turned over (end-over-end) whereby the sheet 76 is disposed over and secured to foam core upper surface 16 and draped over slot 43. In the same way as described above with regard to slot 53, blade 83 is used to urge the mesh sheet 76 firmly into the slot 43 and onto slot surfaces 44 and 48 to which the mesh sheet 76 adheres (FIG. 5B). After the sheet 76 is secured in slot 43, it is applied to the rest of foam core lower surface 22, with second end edge 78 located beyond the first end edge 77 onto the already adhered portion of the mesh sheet 76 such that a short overlap section 84 is formed (FIG. 5B). The entire upper surface 16, lower surface 22, and slots 43 and 53 of foam core member 12 are in this way covered with a mesh material 13 (FIG. 5A) to give the core added strength.

It will be appreciated by those skilled in the art that the geometry of a foam core member 12 that does not have generally parallel side walls and/or parallel end edges will require a mesh sheet 76 of appropriate geometry to cover the foam core upper surface and lower surface within the boundary of the lateral edges and end edges. In some cases, the mesh sheet 76 may have to be applied in more than one piece.

Figure 6A:
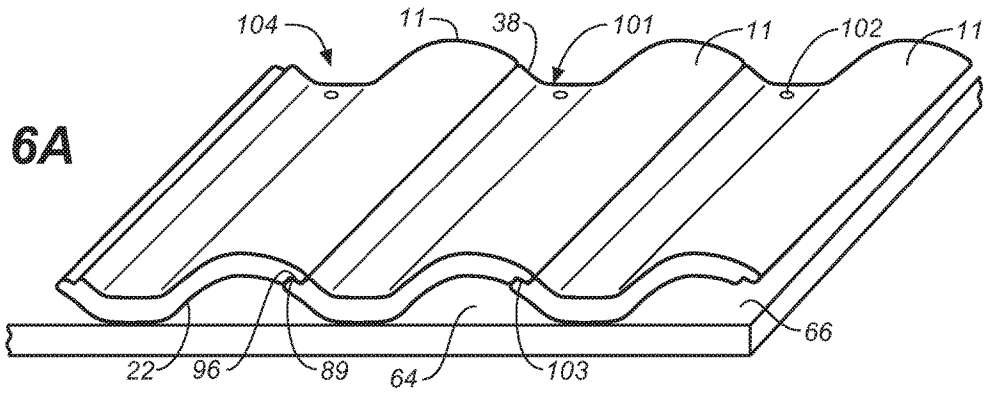
FIG. 6A is a perspective illustration of a tier of several tiles of the invention on a roof structure that are interlocked at their margins.
Figure 6B:
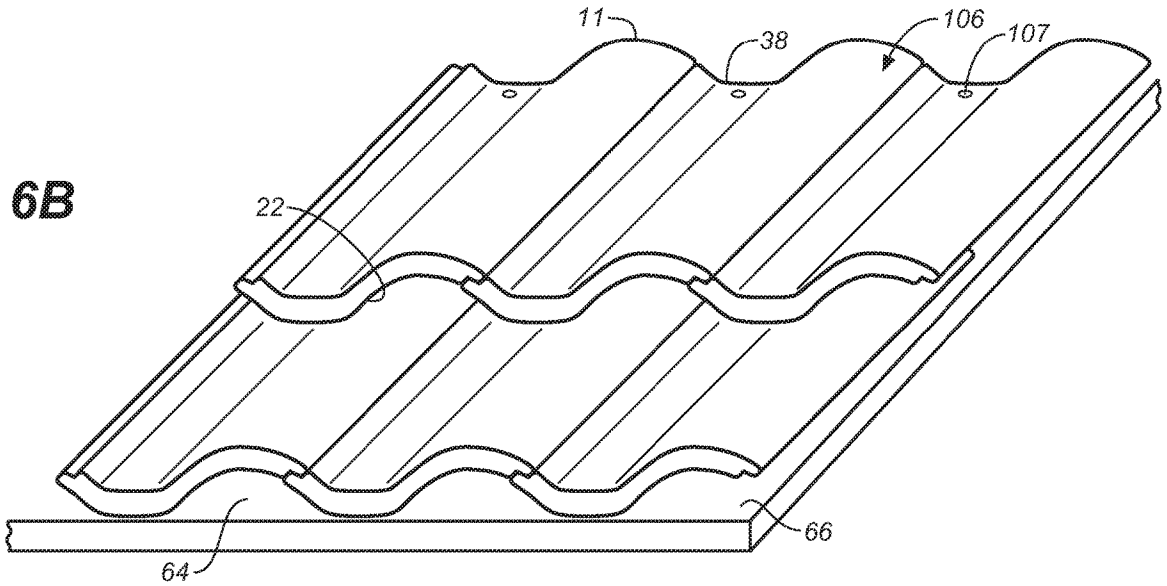
FIG. 6B is the same as FIG. 6A with a second tier of tiles.
Figure 6C:
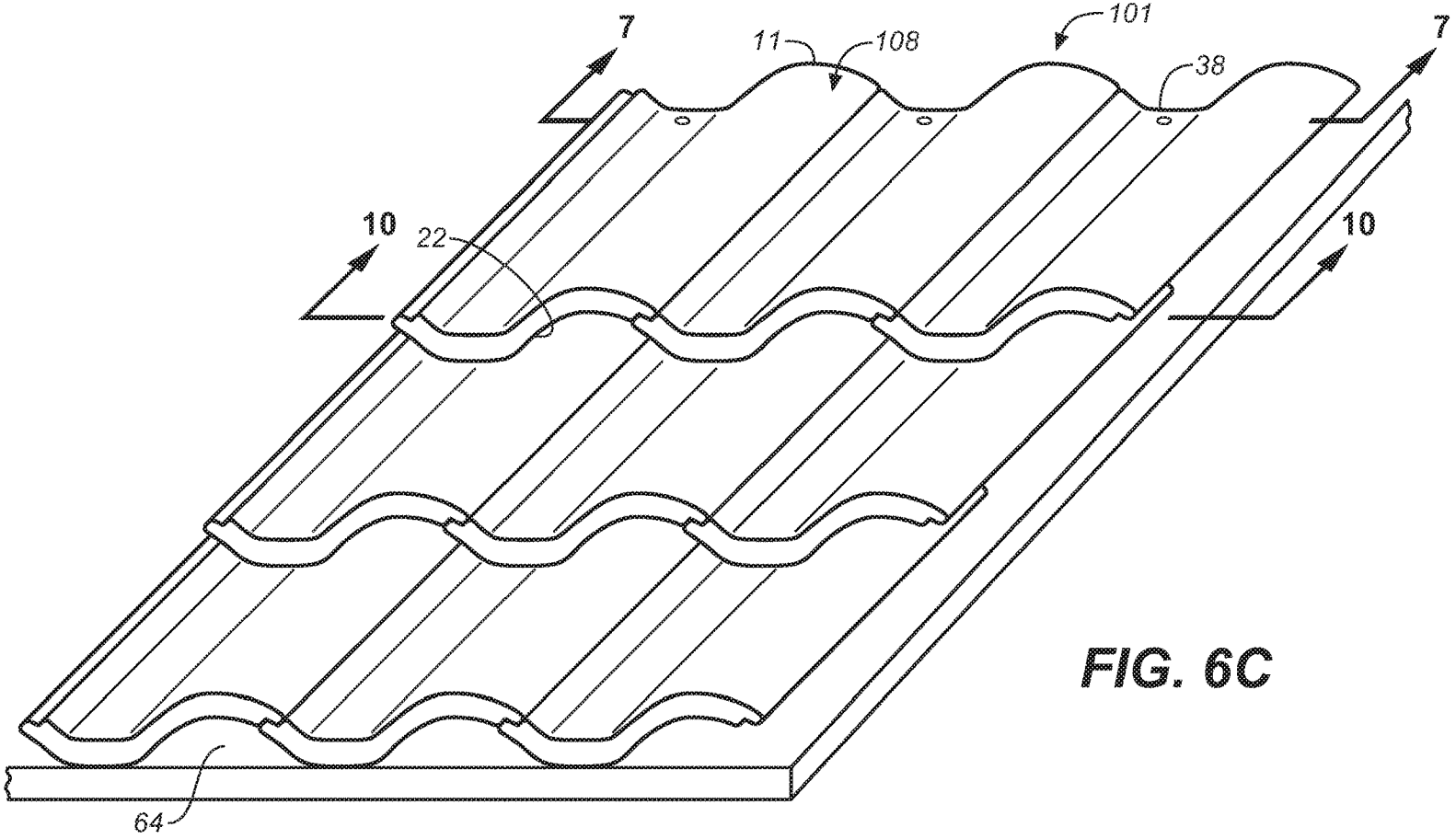
FIG. 6C is the same as FIG. 6B with a third tier of tiles.
Figure 7:
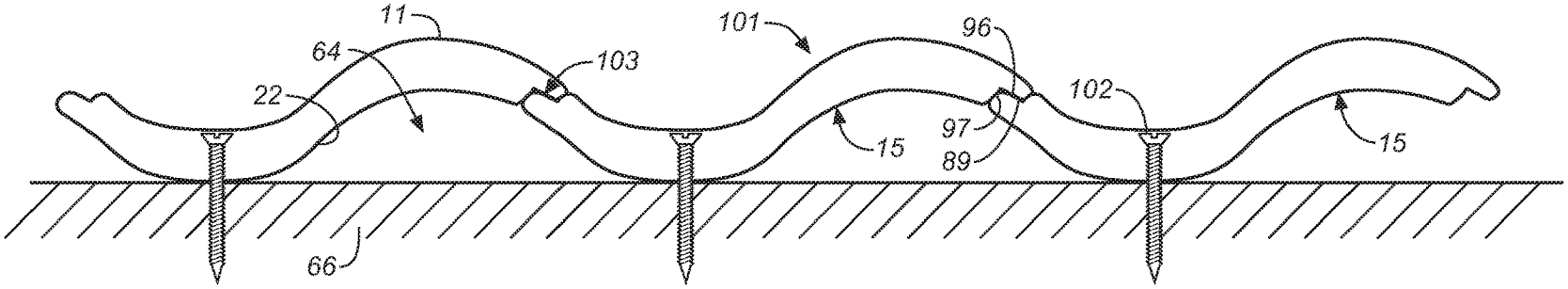
FIG. 7 is a sectional side view taken along the line 7-7 of FIG. 6C.

For those embodiments of the roof tile 11 of the present invention that include a convex arcuate section 15 (FIGS. 1A and 2B), a ventilation channel 64 is automatically formed when the tile is operatively disposed on a roof structure 66 (FIGS. 6A and 7). The ventilation channel 64 reduces the amount of condensation on the underside (lower surface 22) of the tile 11, which eliminates or reduces the deleterious effects of condensation.

After mesh materials 71 and 76 are secured to the foam core 12, a cement-based slurry is applied to cover foam core surfaces 16 and 22 (all the way to and including end edges 19 and 21) and first side wall 33 and, optionally, second side wall 38. When cured to hardness, the cement-based slurry becomes protective coating 14 (FIGS. 1A-1D), providing the tile 11 with the attributes, among others, of structural integrity, strength, fire and pest resistance and durability. The ability to color and texture the coating 14 allows the tile 11 to have a variety of aesthetic appearances. Furthermore, the tile 11 so constructed can be cut to size and fastened in place by driving a nail or screw through it (as more fully described below) without cracking, shattering or otherwise compromising the structural integrity of tile 11.

A cement coating is applied to the surface of the foam and may provide one or more of the following general attributes: appearance, protection and strength. Specific attributes may include high compressive and tensile strength, corrosion resistance, temperature durability, inertness and colorfastness.

The protective coating is made from a cement mixture. Specifically, the mixture may include, in addition to cement, one or more of the following components that are added to water:

- Sand and/or ground glass,
- fly ash or lime,
- pigment,
- anti-efforescence compound,
- resin and saline-based efforescence-reducing and waterproofing agent,
- redispersible binders including those based on a copolymer of vinyl acetate, vinyl versatate and butyl acrylate.

In one embodiment of the invention, the cement coating comprises the following dry ingredients expressed in relative amounts by weight:

34% cement; 58% sand; 5% redispersible binder and 3% lime. It will be understood by those skilled in the art that these relative percentages will adjust should the coating material have other components added, although their relative amounts will stay fairly constant.

Other embodiments are within the following ranges: cement 20-35%; sand 55-71%; redispersible binder 4-5% and lime 3-5%. When used, the resin and saline-based efflorescence-reducing and waterproofing agent constitutes a fraction of 1%, as does the anti-efflorescence compound.

It will be appreciated by those skilled in the art that small deviations from the percentages expressed above will not materially alter the overall performance of the protective coating and are therefore within the scope of the invention.

In some embodiments, it may be advantageous to coat the entire tile. For example, where condensation may collect on the interior surface of the tile, a coating material may help protect the integrity of the foam. Another alternative is to apply the coating to only the surface of the foam that will be exposed to the elements. Also, different coatings may be applied to different surfaces to optimize the resilience of the tile. For example, in one embodiment, a less durable coating may be applied to surfaces that are not exposed to the elements, while a more durable coating is applied to the surfaces that are so exposed. Also, one or more layers of the same or different coatings may be used. For example, in another embodiment, the mixture shown in Table 1 is used to form a slurry that is applied to the mesh-covered foam core member 12 in two separate applications. A ⅛" coating (for example) is applied to the top surface and allowed to cure. A second 1/16" thick coating is applied to the top surface and the bottom surface and allowed to cure. Other combinations of thicknesses of a first coating and a second coating are within the teachings of the invention.

Referring to FIGS. 1A-1D, when the cement-based slurry dries and hardens, it forms a protective coating 14 that covers all or some of the surfaces of the foam core member 12. In all cases, there is an upper surface protective coating 86 that covers the first end member 28, including the first major end extension member 46 and first minor end extension member 49. The upper surface protective coating 86 further extends over the core member upper surface 16 and the second end member 29, including the second minor end extension member 59, and second major end extension member 56. In one embodiment, a lower surface protective coating 87 is also formed and covers the entire lower core surface 22. A first side wall protective coating 85 is also applied. Together, upper surface protective coating 86, lower surface protective coating 87 (when present) and first side wall protective coating 85 comprise the cement-based protective coating 14 on the surfaces of the mesh-covered foam core 12. In some embodiments, it may be possible to eliminate all or a portion of the lower surface protective coating 87 that is not exposed directly to the elements. A protective coating on second side wall 38, which is typically covered by another tile, is optional.

The protective coating 86 fills in the end member slot 43, covers the first major extension member 46 and first minor end extension 51, forming a first L-shaped flange 88 having a first flange engagement member 90 extending generally along the width of the tile 11 and having a first flange engagement surface 89 and a distal end 92. Also formed is a first flange abutment member 93 generally perpendicular to the first flange engagement member 89 and having a first abutment surface 91 generally perpendicular to the first engagement surface 89. The flange surfaces 89 and 91 and end 92 are contiguous with and part of upper surface protective coating 86.

Likewise, the protective coating 86 fills in the second end member slot 53, covers the second major extension member 56 and second minor end extension member 59, forming a second L-shaped flange 94 having a second flange engagement member 95 extending generally along the width of the tile 11 having a second flange engagement surface 96 and a distal end 98. Also formed is a second flange abutment member 99 generally perpendicular to the second flange engagement member 95 and having a second flange abutment surface 97 generally perpendicular to the second flange engagement surface 96. The flange surfaces 97 and 96 and end 98 are contiguous with and part of upper surface protective coating 86.

The first generally L-shaped flange 88 and second generally L-shaped flange 94 are opposite facing (flange 88 having its engagement surface 89 facing upwardly, while flange 94 has its engagement surface 96 facing downwardly).

As illustrated in FIGS. 1A-1D and 7, 8, 9 and 10, the connections 103 between adjacent tiles is the abutment of two cement-coated flange engagement members 88 and 94. When these members are in an abutting relationship, they are not affixed to one another in a way that prevents them from moving (such as pivoting) relative to one another and, as such, the connection between two abutting adjacent tiles is flexible. There is no solid joint formed that creates a monolithic structure between adjacent tiles that could be stressed to breaking in response to movements of the underlying roof structure.

Figure 8:
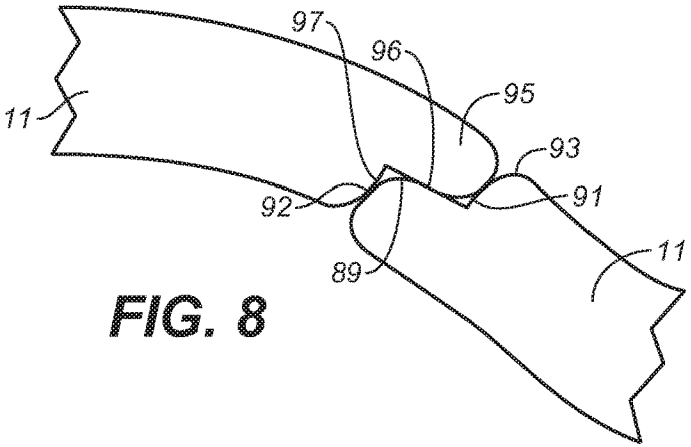
FIG. 8 is an enlarged view of the interlocking margins of two adjacent tiles as illustrated in FIG. 7.

As best seen in FIGS. 6A-6C, 7 and 8, when tiles 11 are placed adjacent to each other, an upwardly facing first engagement surface 89 of one tile can be positioned to overlap with and engage a downwardly facing second engagement surface 96 of an adjacent tile. The first flange end 92 abuts second abutment surface 97 of the adjacent tile 11, while second flange end 93 abuts first abutment surface 91 of the adjacent tile 11 (FIG. 8). An interlocking connection 103 is thus formed by which all of the tiles so interlocked together create a weather covering 101 over the roof structure 66. Because the covering 101 is formed by only a slight overlap of the lateral edges of tiles 11, the number of tiles 11 required to cover a given area of roof structure 66 is fewer than prior art tiles requiring a greater lateral overlap.

While the structures of end members 28 and 29, including flanges 88 and 94, have been illustrated in connection with a roof tile 11 having arcuate sections, the same structure and advantages are applicable to a flat tile 11, as best seen in FIG. 9.

Referring to FIG. 7, one of the advantages of the tiles 11 of the present invention is their ability to absorb the forces of a piercing fastener (e.g., nail or screw) 102 without cracking, breaking or otherwise compromising the structural integrity of the tile. For tiles having an arcuate section 15, fasteners can be advantageously placed where the arcuate section contacts the underlying roof structure. This ability to be so fastened allows each lightweight tile 11 to be quickly and efficiently individually secured directly to the underlying roof structure 66 and thereby kept in place, both relative to the roof structure and to other tiles even under severe weather conditions. Being able to nail (or screw) down each tile 11 permits the elimination of support structures typically required for traditional clay and cement tiles. Because the tiles are sturdy enough to support the weight of an installer, their installation is less labor-intensive than traditional clay or cement tiles and can be completed without tile breakage that unavoidably accompanies the installation of cement and clay tiles.

A weather covering 101 for a roof structure 66 is formed with a plurality of tiles 11 of the present invention arranged in overlapping tiers. Each tier is formed by a plurality of tiles arranged in side-by-side relationship with their respective adjacent end members interlocked.

Referring to FIGS. 6A-6C, 7, 8 and 9, a first tier 104 of interlocked tiles 11 is secured to the roof structure 66 by driving a fastener 102 through each tile (without pre-drilling a hole) and into the roof structure 66 (FIGS. 6A and 7). As shown, the fastener 102 is placed near the leading edge (second side wall 38) of the tile and in a location where a tile of the next tier of tiles 11 will cover it and thereby prevents it from being exposed to precipitation.

A second tier 106 of tiles 11 (FIG. 6B) is disposed in overlapping relationship to the tiles of tier 104 so as to cover fasteners 102. These second tier tiles are secured to the underlying roof structure 66 by driving fasteners 107 through the tiles into the roof structure 66. Additional tiers 108 of tiles 11 are added in the same manner (FIG. 6C) until the roof structure 66 is covered. The trailing edge of a tile 11 (side walls 33) that is uncovered by a subsequent tier tile 11 has a cement-based protective coating 85 (FIG. 1A), while it is optional to so coat the leading edge (side wall 38) being that it is covered.

Referring to FIG. 10, for tiles such as tiles 11 that have an arcuate section 15, the present invention provides that the cross-sectional thickness of the tile be varied in a particular manner so that the lower surface 110 of each tile fits over and nests with substantially the entire upper surface 111 of the tile onto which it is disposed.

Referring to FIG. 11A, a tile 121 has an arcuate section 122 with an arcuate upper surface 123 and an arcuate lower surface 124. The arcuate lower surface 124 generally traces the arc of a circle having a radius $R_1$ and a center $C_1$, while the arcuate upper surface 123 generally traces the arc of a circle having a radius $R_2$ and a center $C_2$ where $R_1$ and $R_2$ are generally equal, while centers $C_1$ and $C_2$ are at different locations. The distance between the two centers $C_1$ and $C_2$ is approximately the same as the thickness of the tile 121 at the apogee 126 of its arc. This formulation provides like tiles with lower surfaces 124 that closely approximate in size and shape upper surfaces, which allows them to be nested in close relationship as illustrated in FIG. 11B. This feature allows the tiles of one tier to be placed at any location along the length of a lower tier tile whereby the amount of overlap can be varied to satisfy aesthetic considerations.

While the variable thickness feature of the tile 121 has been illustrated and described in connection with a tile that is primarily a simple arcuate shape, it will be understood by those skilled in the art that that the same applies to any arcuate section of a tile, including those that are only a portion of the tile and not the entire tile such as the tile 11 of FIG. 1A.

In the prior art, as shown in FIG. 12, tiles 131 with an arcuate section 132 are typically formed to have a non-variable thickness 133 (a singe center $C_1$ but different radii $R_1$ and $R_2$, with the radii difference being equal to the thickness 133 of the tile). As shown, such tiles will not nest in close relationship. To accommodate this, prior art tiles are typically tapered along their lengths so that tiles can be stacked in close relationship, but only at one location along their length.

It will be understood by those skilled in the art that the materials involved do not permit geometric or dimensional precision and, thus, the modifier "generally" is used to accommodate the difference between ideal dimensions and geometric relationships and those possible in the real world. The roofing tiles described herein are designated by Underwriters Laboratories Inc.™ (UL) for installation as a Class A prepared roof covering under the UL790 standard for use on either combustible or noncombustible roof decks when the roofing surface is applied as intended. The combination of light weight (due to EPS composition) and superior fire resistance allows someone additional time to exit a burning building without fear of the roof caving in as it may in the case of heavier clay and concrete roofing tiles.

The roofing surface's Class A resistance to external fire provides significant assurances and greatly increases its effectiveness. The roofing tiles of the present invention have passed three rigorous UL certification tests to attain a Class A certification; specifically, the roofing tiles passed Intermittent Flame tests during which a 1400 degree F. gas flame was intermittently applied to the roofing tile during 15 four-minute cycles and a 12 mile-per-hour air current flowed over the roofing tile. No portion of the roofing tile was blown or fell off the roof deck in the form of flaming or glowing brands, nor was the roof deck exposed by breaking, sliding, cracking or warping of the roofing tiles. No part of the combustible 15/32" plywood roof deck (the roof deck used during the certification process) fell away in the form of glowing particles, nor did it sustain flaming on its underside.

The roofing tiles of the present invention also passed Burning Brand tests in which a 12"×12" brand was ignited and placed on the roofing tiles. Test observations were made until the brand was consumed and testing ceased. No portion of the roof tiles was blown or fell off the roof deck in the form of flaming or glowing brands, and the roofing tiles protected the roof deck such that it was not exposed by breaking, sliding, cracking or warping of the roofing surface. The underside of the roof deck experienced no sustained flaming, and no portions of the roof deck fell away in the form of glowing particles.

In a Spread of Flame test, the roofing tiles were exposed to a gas flame of 1400 degrees F. for ten minutes. With a maximum spread of flame of 3.5 feet and no significant lateral spread of the flame from the path directly exposed to the test flames, the roofing tiles of the present invention passed the test. As with the other tests, no portion of the tiles was blown or fell off the roof deck in the form of flaming or glowing brands, the roof deck was not exposed by breaking, sliding, cracking or warping of the roof surface, and no portions of the tiles fell away in the form of glowing particles.

Thus, the roofing tiles of the present invention are certified to carry the UL Class A listing mark for Prepared Roof Covering Materials. This certifies the roofing tiles of the present invention are effective against severe fire test exposures under which it affords a high degree of fire protection to the roof deck. The tiles are also certified not to slip from their position and are not expected to produce flying brands during severe fire test exposure. In sum, this significant degree of fire resistance is a particularly advantageous and effective feature of the roof tiles of the present invention.

The embodiments described provide a roofing surface that is certified Class A fire resistant under the stringent UL 790 standard. The tiles are strong, lightweight and resist insects, including termites and carpenter ants. The tiles promote a healthier environment because they are lightweight, which (1) cuts down on transportation exhaust emission and (2) requires less lumber to support the surface. Also, the foam used in the tiles act as an insulator that cuts down on construction costs (less insulation needed elsewhere, smaller heating and air conditioning equipment, etc.) and cuts down on the ongoing building energy needs.

Having described the methods and structures in detail and by reference to several preferred embodiments thereof, it will be apparent that modifications and variations are possible without departing from the scope of the invention defined in the following claims.

What is claimed is:

1. A roof tile, a plurality of which can provide a weather membrane over a roof structure comprising;

a foam core member comprising an upper surface and a spaced apart lower surface bounded by a first lateral edge and an opposing spaced-apart second lateral edge and a first end and a spaced-apart second end; wherein the first end includes a first slot and the second end includes a second slot;

a coating of cement-based material covering the foam core member upper surface forming an upper cement surface, a coating of cement-based material covering the foam core member lower surface forming a lower cement surface, wherein the distance between the upper cement surface and the lower cement surface of the thickness of the roof tile; a coating of cement-based material covering the foam core member first lateral edge forming a first lateral edge cement surface, a coating of cement-based material covering the foam core member second lateral edge forming a second lateral edge cement surface wherein the distance between the first lateral edge cement surface and the second later edge cement surface is the length of the roof tile; a coating of cement-based material covering the first foam core member end including filling the first slot and forming a first cement-based material coated L-shaped flange abutment member; a coating of cement-based material covering the second foam core member end including filling the second slot forming a second cement-based material coated L-shaped flange abutment member wherein the distance between the first L-shaped flange abutment member and the second L-shaped flange abutment member is the width of the roof tile;

wherein the first L-shaped flange abutment member is upward facing and the second L-shaped flange abutment member is downward facing and the first and second L-shaped flange abutment members are so shaped that when one tile in a course abuts an adjacent tile in the same course, the adjacent L-shaped flange abutment members engage one another forming a non-rigid flexible connection whereby adjacent roof tiles in a course are able to pivot about their respective L-shaped flange abutment members.

2. The roof tile of claim 1 wherein the width of the roof tile is generally 15 to 20 inches, the length of the roof tile is generally 10 to 20 inches and the thickness of the roof tile is generally 1 to 2 inches.

3. The roof tile of claim 2 wherein the thickness of the cement-based coating is generally ⅛ to ⅜ inches.

4. The roof tile of claim 1 further comprising:

a strengthening material disposed between the the foam core member and the coating of cement-based material including in the first and second slots in the first and second end edges of the foam core member.

5. A roof covering for a pitched roof structure comprising:

a plurality of roof tiles according to claim 1 arranged in multiple tiers of courses running generally perpendicular to the pitch of the roof structure wherein courses of the roof tiles are above and below adjacent courses of roof tiles and wherein the roof tiles of one course overlap the roof tiles of the course below; and wherein abutting L-shaped flanges abutment members form flexible, non-rigid connections.

6. The roof covering of claim 5 further comprising:

a fastener securing one or more roof tiles to the underlying roof structure wherein the fastener punctures the upper and lower cement surfaces of the roof tile.

7. The roof covering of claim 6 wherein the fasteners are driven through the roof tiles at locations to be covered by an overlapping tile.

* * * * *